US006789970B1

(12) United States Patent
Shearon et al.

(10) Patent No.: US 6,789,970 B1
(45) Date of Patent: Sep. 14, 2004

(54) ADJUSTABLE BRUSH CAP

(76) Inventors: Tonya K. Shearon, P.O. Box 321, Neoga, IL (US) 62447; Jackie L. Norman, Jr., 530 E. County Rd., 1450 N, Tuscola, IL (US) 61953

( * ) Notice: Subject to any disclaimer, the term of this patent is extended or adjusted under 35 U.S.C. 154(b) by 0 days.

(21) Appl. No.: 10/639,850

(22) Filed: Aug. 14, 2003

(51) Int. Cl.[7] ..... A46B 11/00
(52) U.S. Cl. ..... 401/127
(58) Field of Search ..... 401/126–130, 401/118

(56) References Cited

U.S. PATENT DOCUMENTS

| | | | | |
|---|---|---|---|---|
| 1,949,902 A | * | 3/1934 | Desser | 401/128 |
| 1,954,068 A | * | 4/1934 | Carpenter | 401/127 |
| 3,554,657 A | * | 1/1971 | Aston | 401/122 |
| 5,096,320 A | | 3/1992 | Norman et al. | |
| 5,116,154 A | | 5/1992 | Fulkerson | |
| 5,529,417 A | | 6/1996 | Burrlader | |
| 5,690,441 A | | 11/1997 | McManus | |
| 5,913,631 A | | 6/1999 | Landry | |
| 6,164,857 A | | 12/2000 | Wolfarth-Brooks et al. | |
| 6,503,014 B2 | | 1/2003 | Louis et al. | |
| 6,530,709 B1 | | 3/2003 | Washington | |

* cited by examiner

*Primary Examiner*—Gregory L. Huson
*Assistant Examiner*—Huyen Le
(74) *Attorney, Agent, or Firm*—John P. Gugliotta

(57) ABSTRACT

An apparatus wherein a fluid container mounts a threadedly removable cap, the threadedly removable cap including an internally threaded bottom well for securement to the container, with an upper cap bore mounting a plunger therewithin, the plunger coaxially aligned with the cap and container and mounting a brush rod and brush. The brush is in contact with a floor of the container in a second position displaced from a first position to permit the brush to project interiorly of the container for access to fluid on the floor of the container. An annular sealing ring encircles an inside of the lower section of the cap, wherein ring is in intimate circumferential contact with brush stem.

2 Claims, 5 Drawing Sheets

ADJUSTABLE BRUSH CAP

BACKGROUND OF THE INVENTION

1. Field of the Invention

The present invention relates generally to applicator brush caps and, more particularly, to a new and improved adjustable brush cap apparatus to permit the brush mounted within the cap to extend for access to fluid contained about a floor of an underlying container.

2. Description of the Related Art

In use of fluids from containers typically applied by brush, such as nail lacquers and other fluids, the container and its depletion of fluid typically positions the brush applicator in a spaced relationship relative to the floor of the container. Such fluid is typically wasted and discarded. The instant invention attempts to overcome deficiencies of the prior art by providing a cap assembly wherein the brush may be extended in relation to the container floor.

A search of the prior art did not disclose any patents that read directly on the claims of the instant invention; however, the following references were considered related:

U.S. Pat. No. 6,530,709, describing a nail polish applicator.

U.S. Pat. No. 6,503,014, describing a decorative container with applicator.

U.S. Pat. No. 5,690,441, describing an extendable, retractable applicator brush.

U.S. Pat. No. 5,529,417, describing a nail, polish bottle with a color matching extension cap.

U.S. Pat. No. 5,116,154, describing a spring-loaded bottle cap/applicator apparatus.

U.S. Pat. No. 4,961,664, describing a nail polish container having a moveable brush.

U.S. Pat. No. 68,163, describing a brush and top for mucilage bottles.

U.S. Pat. No. 6,341,910, describing a retractable-tether lotion application cap.

U.S. Pat. No. 6,164,857, describing a cap with extendable applicator.

U.S. Pat. No. 5,913,631, describing a cosmetic applicator.

Of considerable relevance is U.S. Pat. No. 5,096,320, issued also to the present applicant. While a cap assembly and plunger means are incorporated into this invention in combination, other elements are different enough as to make the combination distinguished over the inventors' own prior art including, but not limited to, incorporating an annular sealing ring encircling an inside of the lower section of the cap, wherein ring is in intimate circumferential contact with brush stem.

SUMMARY OF THE INVENTION

It is therefore an object of the present invention to provide an improved brush cap applicator apparatus.

It is a feature of the present invention to provide an improved brush cap applicator apparatus incorporating an annular sealing ring encircling an inside of the lower section of the cap, wherein ring is in intimate circumferential contact with brush stem.

Briefly described according to one embodiment of the present invention, the present invention provides an adjustable brush cap apparatus wherein the same permits extension of the brush relative to the container interiorly thereof for access of the brush to fluid contained therewithin. As such, the general purpose of the present invention, which will be described subsequently in greater detail, is to provide a new and improved adjustable brush cap apparatus which has all the advantages of the prior art container and brush organizations and none of the disadvantages.

To attain this, the present invention provides an apparatus wherein a fluid container mounts a threadedly removable cap, the threadedly removable cap including an internally threaded bottom well for securement to the container, with an upper cap bore mounting a plunger therewithin, the plunger coaxially aligned with the cap and container and mounting a brush rod and brush. The brush is in contact with a floor of the container in a second position displaced from a first position to permit the brush to project interiorly of the container for access to fluid on the floor of the container.

It is therefore an object of the present invention to provide a new and improved adjustable brush cap apparatus which has all the advantages of the prior art container and brush organizations and none of the disadvantages.

It is another object of the present invention to provide a new and improved adjustable brush cap apparatus which may be easily and efficiently manufactured and marketed.

It is a further object of the present invention to provide a new and improved adjustable brush cap apparatus which is of a durable and reliable construction.

An even further object of the present invention is to provide a new and improved adjustable brush cap apparatus which is susceptible of a low cost of manufacture with regard to both materials and labor, and which accordingly is then susceptible of low prices of sale to the consuming public, thereby making such adjustable brush cap apparatus economically available to the buying public.

Still yet another object of the present invention is to provide a new and improved adjustable brush cap apparatus which provides in the apparatuses and methods of the prior art some of the advantages thereof, while simultaneously overcoming some of the disadvantages normally associated therewith.

Still another object of the present invention is to provide a new and improved adjustable brush cap apparatus wherein the same provides for an extensible brush rod mounting a brush at a lower terminal end thereof to permit access of the brush to fluid about a floor of an associated container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
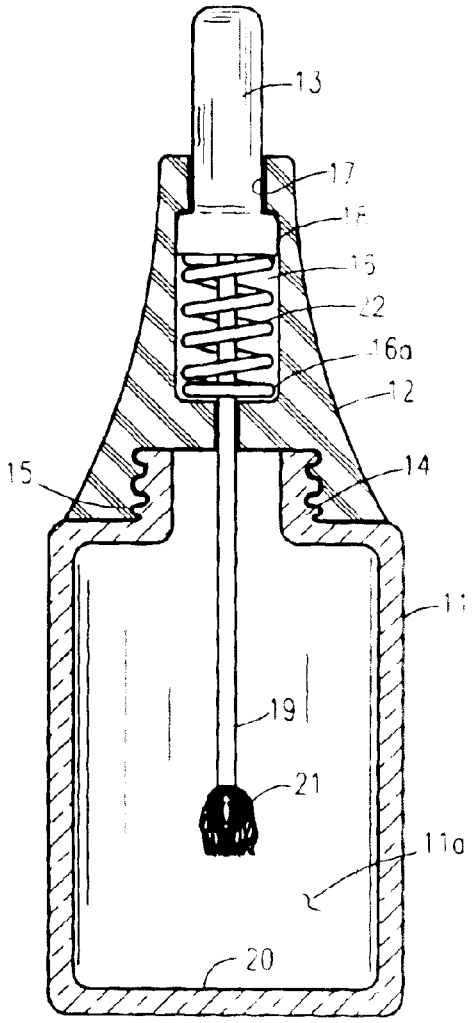
PRIOR ART Fig. 1
FIG. 1 is an orthographic cross-sectional illustration of a prior art brush and fluid container assembly with the brush in an elevated first position.
Figure 2:
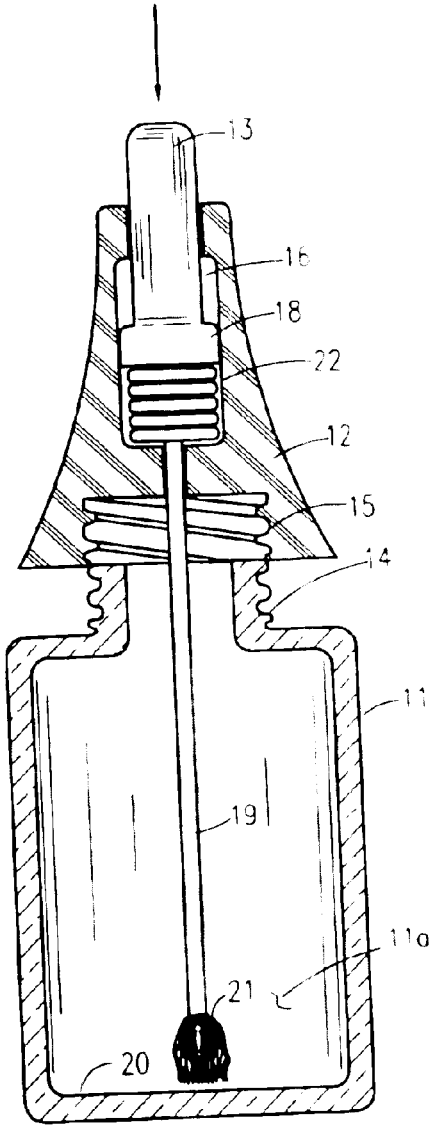
PRIOR ART Fig. 2
FIG. 2 is an orthographic cross-sectional illustration of a prior art brush and fluid container assembly with the brush in a second extended position for access of the brush to fluid on the container floor.
Figure 3:
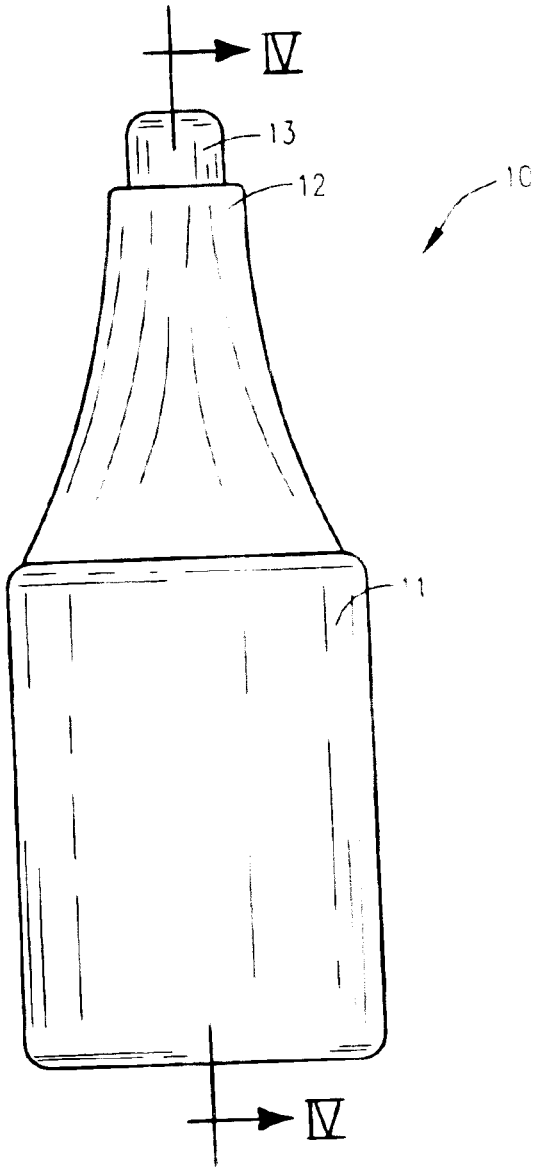
FIG. 3 is an orthographic side view, taken in elevation, of the instant invention.

In order to describe the complete relationship of the invention, it is essential that some description be given to the manner and practice of functional utility and description of the PRIOR ART, as shown in FIGS. 1–2, which illustrates a prior art container and brush assembly 1, wherein the cap 2 mounts a brush rod 3 for extension into the cap, wherein the floor of the container floor is oriented at an acute angle relative to the brush rod for access of the brush rod and brush to fluid on the container floor.

More specifically, the adjustable brush cap apparatus 10 of the instant invention essentially comprises a fluid container 11 removably mounting a cap assembly 12 therefrom, with the cap assembly including a plunger 13 coaxially aligned with the cap assembly. The brush member 21 and details thereof utilized by the organization wherein the brush member includes a central bottom planar surface 23 positioned medially between a right and left arcuate bottom surface 24 and 25 respectively. Sides of the brush member 21 are defined by arcuate right and left sides 26 and 27. Further, the brush member includes a convex outer surface 28 spaced from a concave inner surface 29. The configuration enhances covering and application of fluid onto a fingernail surface of a typical individual's fingernail.

The best mode for carrying out the invention is presented in terms of its preferred embodiment, herein depicted within the FIGS. 3–7.

1. Detailed Description of the Figures

FIGS. 3 through 7 illustrate the cap assembly 12, including an internally threaded cap cavity 15 directed through a bottom surface of the cap floor coaxially aligned with the cap, with the container including an externally threaded container conduit 14 mounted to a top surface of the container. The cap assembly 12 further includes an upper cap bore 16 coaxially aligned with the cap defined by a first diameter and including a cap bore floor 16*a* mounted orthogonally to the cap bore 16. A cap bore neck 17 is defined by a second diameter less than the first diameter and slidably receives a body of the plunger assembly 13 therethrough, with the plunger 13 including a plunger cylindrical shoulder 18 orthogonally formed to a lower terminal end of the plunger 13 coaxially aligned therewith and defined by a third diameter less than the first diameter but greater than the second diameter. A brush rod 19 is coaxially and integrally mounted to the plunger 13 and extending downwardly therefrom and terminating in a brush member 21. A captured spring 22 is contained between the bottom surface of the plunger shoulder 18 and the cap bore floor 16*a*, whereupon extension of the brush member 21 from a first position elevated from the housing cavity floor 20 defined within the housing cavity 11*a* to a second position, wherein the brush member 21 is in contact with the housing cavity floor 20 permitting access of the brush member 21 to fluid normally positioned between the brush member 21 and the housing cavity floor 20.

Figure 6:
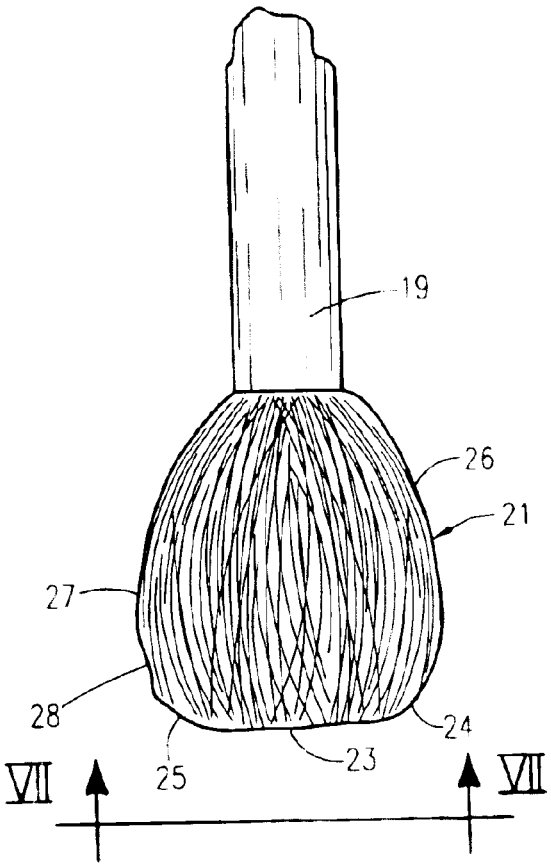
FIG. 6 is an orthographic detailed illustration of the brush of the instant invention.
Figure 7:
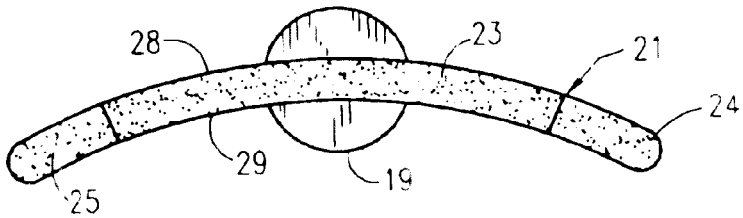
FIG. 7 is an orthographic view, taken along the lines VII—VII of FIG. 6 in the direction indicated by the arrows.

FIGS. 6 and 7 illustrate the brush member 21 and details thereof utilized by the organization wherein the brush member includes a central bottom planar surface 23 positioned medially between a right and left arcuate bottom surface 24 and 25 respectively. Sides of the brush member 21 are defined by arcuate right and left sides 26 and 27. Further, the brush member includes a convex outer surface 28 spaced from a concave inner surface 29. The configuration enhances covering and application of fluid onto a fingernail surface of a typical individual's fingernail.

Figure 4:
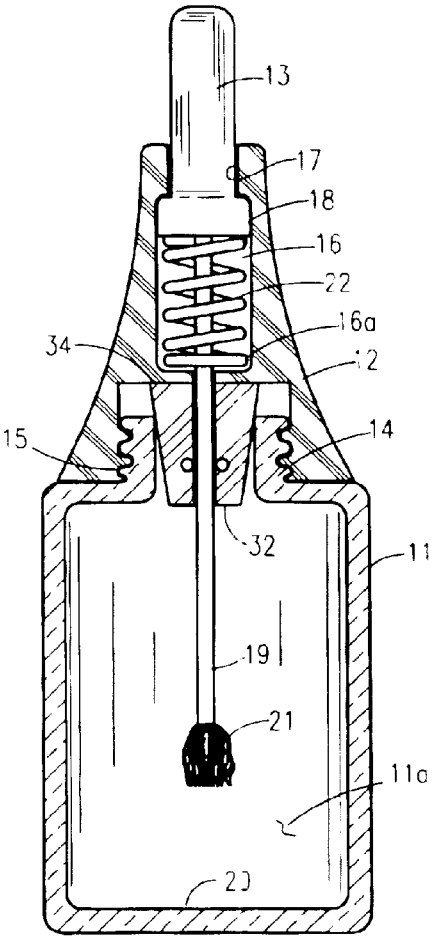
FIG. 4 is an orthographic cross-sectional illustration of the invention as set forth in FIG. 3, taken along the lines IV—IV in the direction indicated by the arrows with the brush in an elevated first position.
Figure 5:
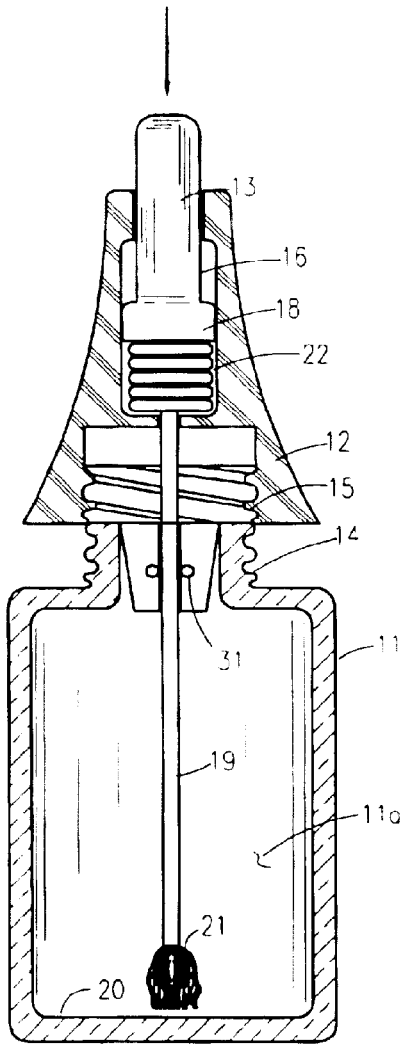
FIG. 5 is an orthographic cross-sectional illustration of the instant invention with the brush in a second extended position for access of the brush to fluid on the container floor.

An annular sealing ring 30 is shown is FIGS. 4 and 5 as a conically shaped cylindrical collar circumscribing the brush rod 19 and having a lowermost diameter 32 sufficiently narrow to fully insert and completely penetrate the externally threaded container conduit 14 and enter the fluid chamber 11*a*. The uppermost diameter 34 is sufficiently wide as to be prevented from inserting into the threaded container conduit 14 such that as the cap assembly 12 is threadingly engaged onto the bottle 11, the ring 30 is impinged against the inner surface of the conduit 14 in such a manner as to form a seal therebetween such as to allow the fluid chamber 11*a* to remain leak-proof, even under moderate pressure. The brush rod 19 can be frictionally sealed within the ring 30 such as to maintain such moderate pressure while still allowing the brush rod 19 to translate between a first retracted position, as shown in FIG. 4, and a second extended position for access of the brush to fluid on the container floor, as shown in FIG. 5. Optionally, a sealing means 36, shown herein as an "O" ring, can be incorporated between the brush rod 19 and the inner channel of the annular ring 30 in order to increase the ability to to allow the fluid chamber 11*a* to remain leak-proof, even under moderate pressure.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. In an adjustable brush cap apparatus having a fluid container, the fluid container defined by a container wall and a container floor, and the container including a housing cavity, and the housing cavity bounded at its lower end by the housing cavity floor, and the container including an externally threaded container conduit formed to an upper portion of the container wall with the upper portion spaced from the housing cavity floor, and including a cap assembly, the cap assembly including a cap assembly bottom floor with an internally threaded cap cavity coaxially directed into the cap assembly floor, the cap cavity threadedly securable to the externally threaded container conduit, and plunger means coaxially and reciprocatably mounted to the cap assembly, including a brush rod coaxially mounted to the plunger means, and a brush member mounted to a lower terminal end of the brush rod, wherein the brush assembly is arranged for extension from a first position, wherein the brush member is spaced from the housing cavity floor to a second position, wherein the brush member is in contact with the housing cavity floor, and wherein the cap assembly includes an upper cap bore coaxially aligned with the cap assembly and defined by a first diameter, and the cap bore in communication with a cap bore neck coaxially aligned with the cap bore and extending upwardly from the cap bore through a top wall of the cap assembly, wherein the cap bore neck is defined by a second diameter less than the first diameter, and the plunger means includes a cylindrical plunger body slidably mounted within the cap bore neck, and the plunger body including a cylindrical plunger shoulder defined by a third diameter less than the first diameter and greater than the second diameter to capture the plunger shoulder within the cap bore, and a spring member captured between a bottom surface of the plunger shoulder and a cap bore floor formed at a bottom terminal end of the cap bore, with the brush rod coaxially mounted medially of the spring, and wherein the brush member includes a bottom surface, wherein the bottom surface includes a central planar surface, a right arcuate surface and a left arcuate surface defining the bottom surface, and the brush member further including an arcuate right side and arcuate left side, and the brush member further defined by a convex outer surface and a convex inner surface directed between the arcuate right side and arcuate left side and the bottom surface, and wherein the cap assembly includes an externally threaded upper end and internally threaded cover cap coaxially aligned with the cap assembly securably and removably mounted to the threaded cap upper end, the improvement comprising:

incorporating an annular sealing ring encircling an inside of the lower section of the cap, wherein said sealing ring is in intimate circumferential contact with brush stem wherein said annular sealing ring comprises a conically shaped cylindrical collar circumscribing said brush rod;

a lowermost diameter sufficiently narrow to full insert and completely penetrate said externally threaded container conduit and enter said fluid chamber;

an uppermost diameter sufficiently wide as to be prevented from inserting into the threaded container conduit such that as said cap assembly is threadingly engaged onto said bottle, said sealing ring is impinged against an inner surface of said conduit in such a manner as to form a seal there between such as to allow the fluid chamber to remain leak-proof, even under moderate pressure; and sealing means incorporated between said brush rod and an inner channel of said annular ring.

2. In the adjustable brush cap apparatus of claim 1, wherein said sealing means is an "O" ring.

* * * * *